US006433469B1

(12) United States Patent
Tsuruoka et al.

(10) Patent No.: US 6,433,469 B1
(45) Date of Patent: Aug. 13, 2002

(54) CATHODE RAY TUBE HAVING AN INTERNAL VOLTAGE-DIVIDING RESISTOR

(75) Inventors: Atsushi Tsuruoka; Sakae Ishii; Satoru Miyamoto; Hisao Nakamura, all of Mobara (JP)

(73) Assignees: Hitachi, Ltd., Tokyo; Hitachi Electonic Devices Co., Ltd., Mobara, both of (JP)

( * ) Notice: Subject to any disclaimer, the term of this patent is extended or adjusted under 35 U.S.C. 154(b) by 0 days.

(21) Appl. No.: 09/514,285

(22) Filed: Feb. 28, 2000

(51) Int. Cl.[7] ..... H01J 29/96; H01J 23/16

(52) U.S. Cl. ..... 313/414; 313/449; 313/417; 315/368.15; 338/308

(58) Field of Search ..... 313/414, 412, 313/43, 449, 417; 315/386.15, 3, 382.1, 15; 338/308

(56) References Cited

U.S. PATENT DOCUMENTS 4,349,767 A * 9/1982 Muramoto et al. ..... 313/414
4,760,370 A * 7/1988 Nikaido et al. ..... 313/449
5,914,559 A * 6/1999 Muchi et al. ..... 313/414
6,005,472 A * 12/1999 Mitsuhashi ..... 338/308
6,011,349 A * 1/2000 Amano et al. ..... 313/417

* cited by examiner

*Primary Examiner*—Nimeshkumar D. Patel
*Assistant Examiner*—Karabi Guharay
(74) *Attorney, Agent, or Firm*—Antonelli, Terry, Stout & Kraus, LLP

(57) ABSTRACT

A cathode ray tube includes an evacuated envelope having a panel portion having a phosphor screen, a neck portion and a funnel portion connecting the panel portion and the neck portion; an electron gun housed in the neck portion having a cathode, a first grid electrode, a second grid electrode, plural focus electrodes and an anode arranged in the order named and fixed in predetermined axially spaced relationship by two glass beads; a voltage-dividing resistor attached to one of the two glass beads for producing an intermediate voltage to be applied to a first one of the plural focus electrodes adjacent to the anode by dividing a voltage applied to the anode; and a metal conductor facing and attached to a second one of the plural focus electrodes to surround the voltage-dividing resistor and the one of the two glass beads, the second one of the plural focus electrodes being disposed upstream of the first one of the plural focus electrodes. The voltage-dividing resistor includes a first overcoat insulating film, a resistance element, an insulating substrate and a second overcoat insulating film stacked in the order named from the first overcoat insulating film facing the one of the two glass beads, and a portion of the second overcoat insulating film containing a region thereof facing the metal conductor is made locally thicker than a remainder of the second overcoat insulating film.

6 Claims, 9 Drawing Sheets

CATHODE RAY TUBE HAVING AN INTERNAL VOLTAGE-DIVIDING RESISTOR

BACKGROUND OF THE INVENTION

The present invention relates to a cathode ray tube, and in particular to a color cathode ray tube having an electron gun employing an internal voltage-dividing resistor.

Color cathode ray tubes used in TV receivers or information terminals, house an electron gun for emitting a plurality (usually three) of electron beams at one end of an evacuated envelope, a phosphor screen formed of phosphors coated on an inner surface of the evacuated envelope at the other end thereof for emitting light of a plurality (usually three) of colors, and a shadow mask which is closely spaced from the phosphor screen and serves as a color selection electrode. The electron beams emitted from the electron gun are deflected to scan the phosphor screen horizontally and vertically to form a rectangular raster by magnetic fields generated by a deflection yoke mounted externally of the evacuated envelope and display a desired image on the phosphor screen.

FIG. 8 is a cross-sectional view for explaining an exemplary configuration of a color cathode ray tube, and in FIG. 8, reference numeral 1 denotes a panel portion, 2 is a neck portion for housing an in-line type electron gun 9, 3 is a funnel portion for connecting the panel portion 1 and the neck portion 2, 4 is a phosphor screen, 5 is a shadow mask, 6 is a mask frame, 7 is a magnetic shield, 8 is a mask suspension mechanism, 10 is a deflection yoke, 11 is an internal conductive coating, 12 is a shield cup, 13 is a contact spring, 14 is a getter and 15 are stem pins.

In this color cathode ray tube, an evacuated envelope is formed by the panel portion 1, the neck portion 2 and the funnel portion 3, and electron beams 16 emitted from the electron gun 9 housed in the neck portion 2 scan the phosphor screen 4 two-dimensionally by being subjected to the horizontal and vertical deflection magnetic fields produced by the deflection yoke 10.

The electron beams 16 are modulated in amount by video signals supplied via the stem pins 15, are color-selected by the shadow mask 5 disposed immediately in front of the phosphor screen 4, and impinge upon the phosphors of the corresponding primary colors to reproduce a desired color image.

Such cathode ray tubes employ a multistage focus lens system to obtain sufficiently small electron beam spots over the entire phosphor screen.

Japanese Patent Application Laid-open No. Hei 10-255682 (laid-open on Sep. 25, 1998), for example, discloses an "extended field lens" serving as a main lens formed by disposing an intermediate electrode between an anode and a focus electrode. FIG. 9 is a schematic longitudinal cross-sectional view of an electron gun of a cathode ray tube disclosed in Japanese Patent Application Laid-open No. Hei 10-255682 and FIG. 10 is a cross-sectional view taken along line X—X of the electron gun shown in FIG. 9. The electron gun is of the extended field lens type comprising three equally spaced coplanar cathodes 309 (one for each electron beam), a first electrode 301, a second electrode 302, a third electrode 303, a fourth electrode 304, a 5-1st electrode (a focus electrode) 305, a 5-2nd electrode (a focus electrode) 306, an intermediate electrode 310, a sixth electrode (an anode electrode) 307 and a shield cup 308 arranged coaxially in the order named from the cathodes 309, and the cathodes and the electrodes are fixed in predetermined spaced relationship on a pair of glass beads 311.

A voltage-dividing resistor 312 fabricated on a ceramic substrate is housed within the cathode ray tube to obtain a voltage to be supplied to the intermediate electrode 310 within the cathode ray tube, and the voltage-dividing resistor 312 is fixed to one of the glass beads 311. A metal wire 314*a* surrounds the glass beads 311 and the voltage-dividing resistor 312 and is welded to the intermediate electrode 310 as shown in FIG. 10.

The electrons emitted from the cathodes 309 are focused by a prefocus lens formed by the cathodes 309, the first electrode 301, the second electrode 302 and the third electrode 303, next by a pre-main lens formed by the third electrode 303, the fourth electrode 304 and the 5-1st electrode 305, and then by a main lens formed by the 5-2nd electrode 306, the intermediate electrode 310 and the sixth electrode 307, onto a phosphor screen, and form an image on the viewing screen of the cathode ray tube.

The voltage applied to the intermediate electrode 310 is selected lower than anode voltage, but higher than voltages applied to the focus electrodes by dividing the anode voltage using the voltage-dividing resistor 312. Provision of the intermediate electrode 310 forms a lens of the extended field type in which the potential distribution along the tube axis is made gentle from the anode electrode to the focus electrodes, reduces spherical aberration and consequently the diameter of the electron beam spots is reduced.

As shown in FIG. 10, the amount of electrical charges accumulated on the inner wall of a neck glass 317 is stabilized by attaching the metal wire 314*a* to the intermediate electrode 310 such that the metal wire 314*a* surrounds the glass bead 311 and the voltage-dividing resistor 312.

After the completed electron gun is inserted into the neck glass 317, a portion of metal contained in the metal wire 314*a* is evaporated to form metal films (not shown) on the inner wall of the neck glass 317 and the surface of the voltage-dividing resistor 312 and the glass bead 311 by heating the metal wire 314*a* using an external radio-frequency induction heater such that more stable potential is established on the inner wall of the neck glass 317.

In the manufacture of a cathode ray tube, after the cathode ray tube has been exhausted of gases and sealed, so-called spot-knocking (high-voltage stabilization) of applying a high voltage of about twice the normal operating voltage for the cathode ray tube to its anode is carried out to remove projections in electrodes of the electron gun or foreign particles within the cathode ray tube by forcing arcing between the electrodes and between the electrodes and the inner wall of the neck portion and to thereby prevent occurrence of arcing within the cathode ray tube during the normal operation of the completed cathode ray tube.

But, in a cathode ray tube employing the extended field lens formed by applying a voltage divided from the anode voltage using an internal voltage-dividing resistor to the intermediate electrode and the above-mentioned metal wire for suppression of discharge attached to and facing a focus electrode upstream of the intermediate electrode, when the spot-knocking of applying a high voltage of about 60 kv, for example, to the anode electrode is carried out with all the electrodes except for the anode electrode and the intermediate electrode being grounded, cracking occurs passing through the layers of the internal voltage-dividing resistor because the metal wire for suppression of discharge surrounding the voltage-dividing resistor is grounded and therefore a voltage difference of about 30 kV is produced between the metal wire and the resistance element of the voltage-dividing resistor, and consequently, there has been a problem in that voltages sufficiently high for spot-knocking are not generated between the anode electrode and the intermediate electrode adjacent thereto and between the intermediate electrode and another electrode facing the cathode side of the intermediate electrode, as a result sufficient effects of spot-knocking are not obtained and satisfactory withstand voltage characteristics are not secured within the cathode ray tube.

SUMMARY OF THE INVENTION

It is an object of the present invention to provide a cathode ray tube incorporating an internal voltage-dividing resistor and having withstand voltage characteristics improved by heightening effects of spot-knocking preventing occurrence of cracking passing through the layers of the internal voltage-dividing resistor during the spot-knocking procedure.

To accomplish the above object, in accordance with an embodiment of the present invention, there is provided a cathode ray tube comprising: an evacuated envelope comprising a panel portion having a phosphor screen formed on an inner surface thereof, a neck portion and a funnel portion connecting said panel portion and said neck portion; an electron gun housed in said neck portion comprising at least one cathode, a first grid electrode, a second grid electrode, a plurality of focus electrodes and an anode arranged in the order named for focusing at least one electron beam emitted from said at least one cathode on said phosphor screen, said at least one cathode, said first grid electrode, said second grid electrode, said plurality of focus electrodes and said anode being fixed in predetermined axially spaced relationship by at least two glass beads; a voltage-dividing resistor attached to one of said at least two glass beads for producing an intermediate voltage to be applied to a first one of said plurality of focus electrodes adjacent to said anode by dividing a voltage applied to said anode; and a metal conductor facing and attached to a second one of said plurality of focus electrodes to surround said voltage-dividing resistor and said one of said at least two glass beads, said second one of said plurality of focus electrodes being disposed upstream of said first one of said plurality of focus electrodes; said voltage-dividing resistor comprising a first overcoat insulating film, a resistance element, an insulating substrate and a second overcoat insulating film stacked in the order named from said first overcoat insulating film facing said one of said at least two glass beads, and a portion of said second overcoat insulating film containing a region thereof facing said metal conductor being made locally thicker than a remainder of said second overcoat insulating film.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

Figure 1:
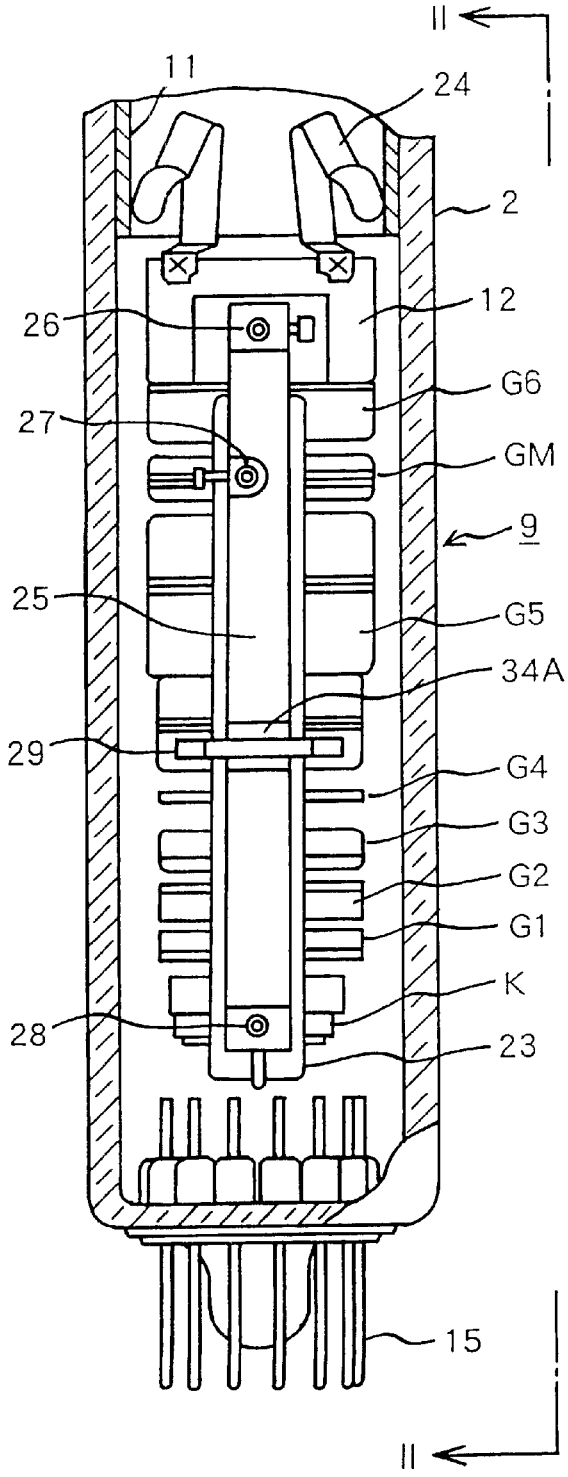
FIG. 1 is a partially broken-away front view of a first embodiment of a color cathode ray tube according to the present invention.

The detailed explanation will be given to the embodiments according to the present invention by reference to the drawings. Like reference numerals denote like or functionally similar parts throughout the figures of the drawings.

Figure 2:
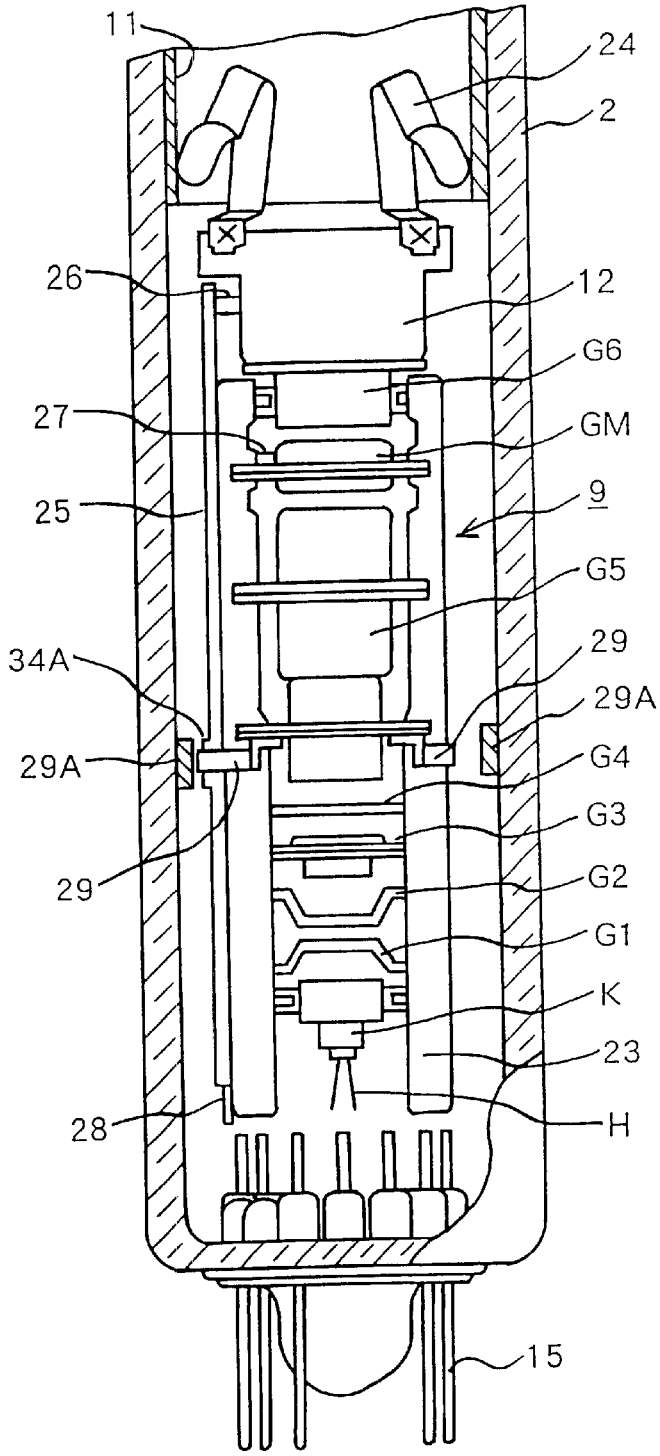
FIG. 2 is a partially broken-away side view of the color cathode ray tube taken along line II—II of FIG. 1.

FIGS. 1 and 2 show the essential part of an electron gun for explaining a first embodiment of a color cathode ray tube according to the present invention, FIG. 1 being a partially cut-away front view of the color cathode ray tube and FIG. 2 being a partially cut-away side view of the color cathode ray tube taken along line II—II of FIG. 1.

The three-beam in-line type electron gun 9 comprises a cathode K, a first grid electrode G1, a second grid electrode G2, a third grid electrode G3, a fourth grid electrode G4, a fifth grid electrode G5, an intermediate electrode GM, and a sixth grid electrode G6. The first to sixth grid electrodes G1–G6 and the intermediate electrode GM are fixed on a pair of glass beads (multiform glass beads) 23 in the predetermined order by embedding peripheral flanges of the grid electrodes and the intermediate electrode or support tabs attached to the grid electrodes and the intermediate electrode in a pair of glass beads 23. Bulb spacers 24 center the axis of the electron gun 9 within the neck portion 2. The electron gun 9 is supported on stem pins 15 via leads (not shown) and the cathodes K are heated by the heaters H contained in the cathodes K.

The internal voltage-dividing resistor 25 is mounted on the side of the glass bead 23 facing the neck portion 2 such that the side of the ceramic substrate of the internal voltage-dividing resistor 25 on which the resistance element 32 is formed faces toward the glass bead 23, that is, the overcoat glass film 33 faces the glass bead 23. A high-voltage terminal 26 of the internal voltage-dividing resistor 25 is connected to a shield cup 12 attached to the sixth grid electrode G6, an intermediate-voltage terminal 27 is connected to the intermediate electrode GM, and a low-voltage terminal 28 is grounded via one of the stem pins 15.

A shield wire 29 for suppression of discharge is disposed to surround the internal voltage-dividing resistor 25 and one of the glass beads 23 mounting the resistor 25 and is connected to the fifth grid electrode G5. The shield wire 29 for suppression of discharge can be made from nickel, stainless steel or the like. A conductive film 29A for suppression of discharge shown in FIG. 2 is formed on the inner wall of the neck portion 2 by evaporating a portion of metal contained in the shield wire 29 onto the inner wall of the neck portion 2 heating the shield wire 29 using a radio-frequency induction heater (not shown) external to the neck portion 2 after the spot-knocking step.

Figure 3:
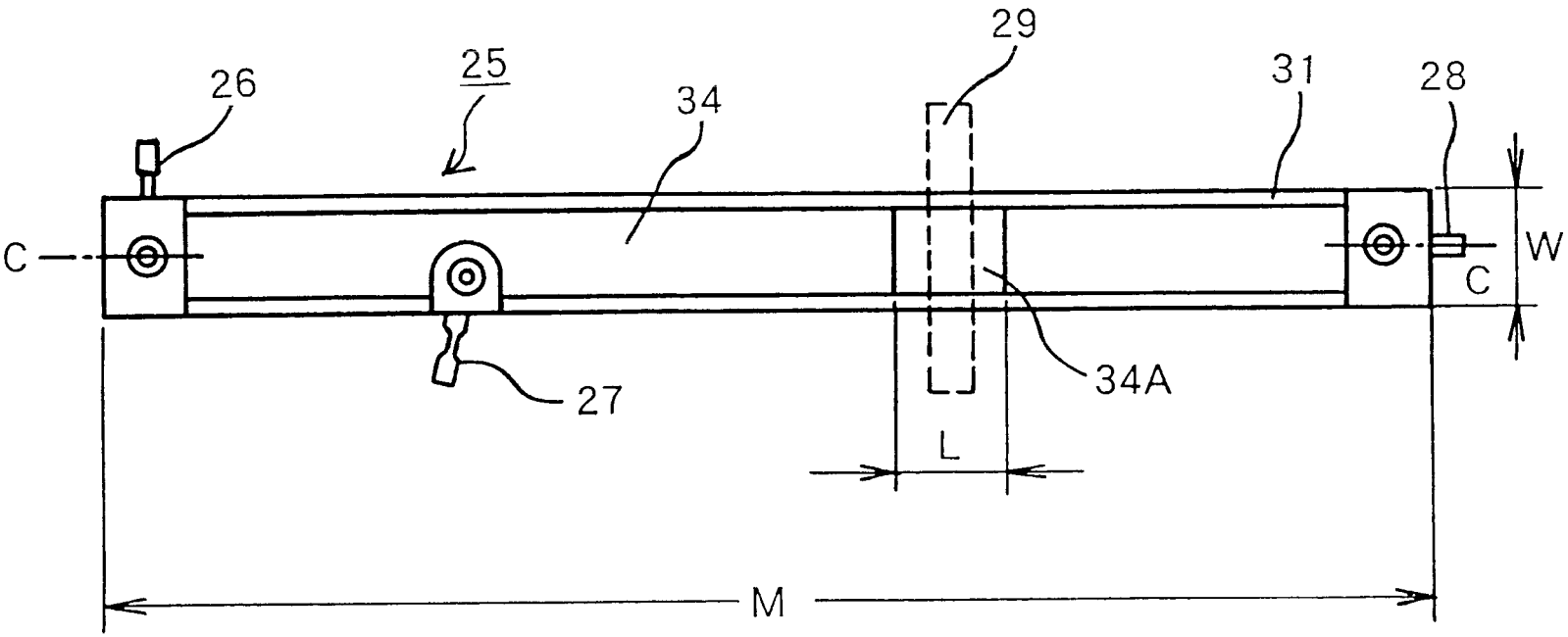
FIG. 3 is a top view of a voltage-dividing resistor used in the color cathode ray tube of the present invention.
Figure 4:
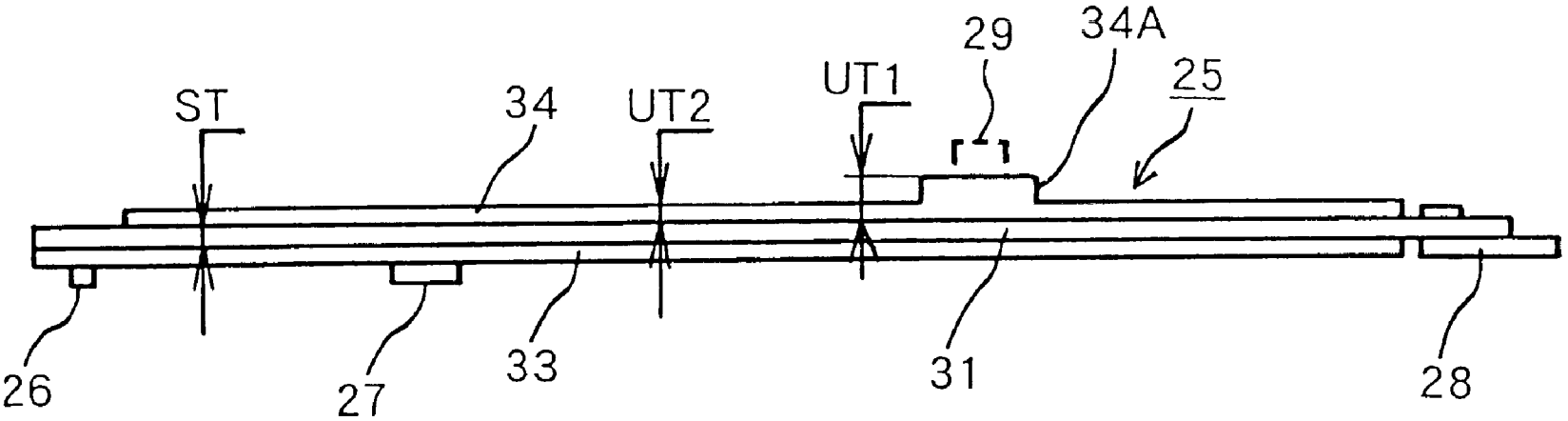
FIG. 4 is a side view of the voltage-dividing resistor of FIG. 3.
Figure 5:
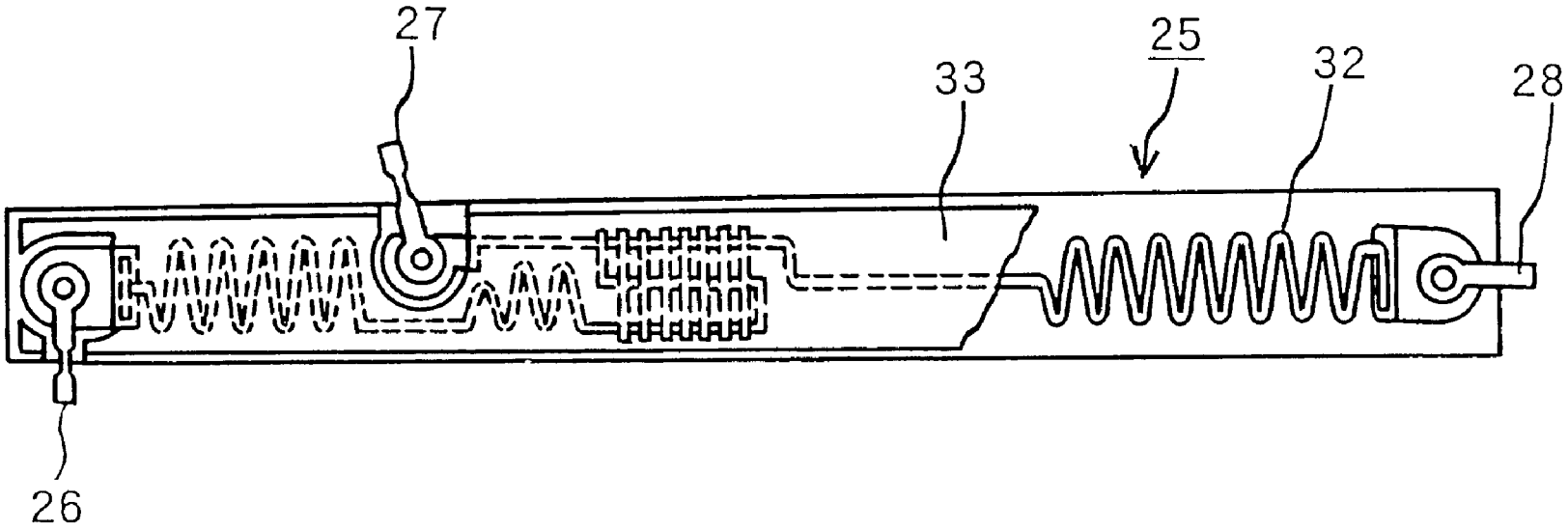
FIG. 5 is a partially broken-away rear view of the voltage-dividing resistor of FIG. 3.

The internal voltage-dividing resistor 25 of the present invention will be explained in detail. FIGS. 3, 4 and 5 are a top view, a side view and a partially broken-away rear view of the voltage-dividing resistor 25, respectively. The internal voltage-dividing resistor 25 comprises a resistance element 32 made chiefly of ruthenium oxide and formed on an alumina ceramic substrate 31, and the high-voltage terminal 26, the low-voltage terminal 28 and the intermediate-voltage terminal 27 disposed at two ends of the resistance element 32, at the point intermediate between the two ends, respectively. The resistance element 32 is covered with an overcoat glass film 33 (made of lead-containing glass, for example), and the top surface of the ceramic substrate 31 is covered with an overcoat glass film 34 (made of lead-containing glass, for example).

The ceramic substrate 31 is fabricated by shaping $Al_2O_3$paste into a desired shape of a desired size and firing it. The thus fabricated substrate 31 itself is porous in the strict sense and, consequently there is likelihood of local concentration of electric fields in the ceramic substrate 31. Therefore the overcoat glass film 34 is formed on the side of the ceramic substrate 31 opposite from the resistance element 32 so as to suppress arcing from the shield wire 29 on which electric charges are concentrated to the resistance element 32 and to thereby prevent the fracture of the voltage-dividing resistor 25 during the normal operation of the completed cathode ray tube.

Generally, the overall length M and the width W of the internal voltage-dividing resistor 25 and the thickness ST of the ceramic substrate 31 are approximately in ranges of 50 mm to 100 mm, 5 mm to 10 mm and 0.6 mm to 1.0 mm, respectively.

In FIGS. 3 and 4, the position corresponding to the shield wire 29 for suppression of discharge is indicated by broken lines. In the present invention, as shown in FIGS. 3 and 4, the thickness UT1 of a portion 34A of the overcoat glass film 34 having the width L and containing a portion thereof facing the shield wire 29 for suppression of discharge is made thicker than the thickness UT2 of the remainder of the overcoat glass film 34 so as to prevent occurrence of cracking passing through the layers in the portion of the overcoat glass film 34 facing the shield wire 29 for suppression of discharge.

An embodiment of the internal voltage-dividing resistor 25 in accordance with the present invention will be explained, assuming that a voltage difference between the resistance element 32 and the shield wire 29 for suppression of discharge is about 30 kV in the spot-knocking procedure.

It is assumed that the dielectric strengths of the ceramic substrate 31 and the overcoat glass film 34 are approximately 15 kV/mm and approximately 85 kV/mm, respectively, and the thickness ST of the ceramic substrate 31 is approximately in a range of 0.6 mm to 1.0 mm.

It is preferable that the thickness UT1 of the thickened portion 34A of the overcoat glass film 34 is at least 0.25 mm when the thickness ST of the ceramic substrate 31 is 0.6 mm, and the thickness UT1 is at least 0.19 mm when the thickness ST is 1.0 mm. The maximum of the thickness UT1 is approximately 0.45 mm because the voltage-dividing resistor 25 is mounted on the glass bead 23 of the electron gun 9. It is preferable that the length L of the thickened portion 34A as measured in a direction of the longitudinal axis of the cathode ray tube is three to eight times the length of the shield wire 29 for suppression of discharge as measured in the direction of the longitudinal axis of the cathode ray tube.

The thickness UT2 of the overcoat glass film 34 except for the thickened portion 34A is approximately 0.05 mm.

Now, an exemplary method of fabrication of the thickened portion 34A will be explained by reference to FIGS. 3 and 4. First a layer of powdered glass is coated to a uniform thickness on one surface of the ceramic substrate 31 and then a second layer of the powdered glass having a pattern corresponding to the thickened portion 34A is printed on the first layer of the powdered glass by silk screening a paste containing the powdered glass. Then the dried powdered layers are fired to complete the overcoat glass film 34 including the thickened portion 34A. The silk screening of the pattern corresponding to the thickened portion 34A may be repeated to obtain the desired value of the thickness UT1 of the thickened portion 34A in the completed voltage-dividing resistor 25.

Figure 6:
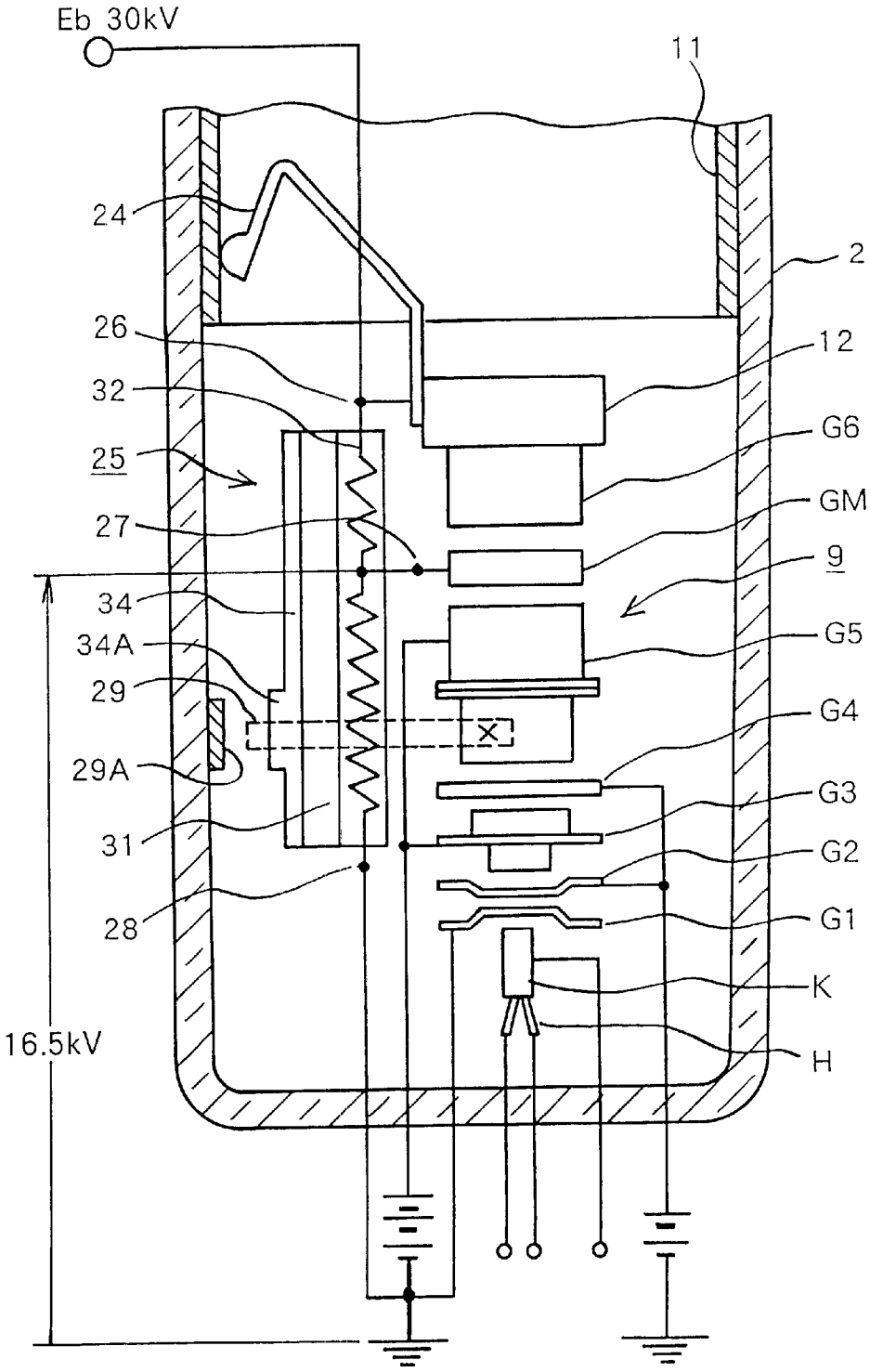
FIG. 6 is a schematic illustration of an electrical configuration for the color cathode ray tube of the present invention of FIG. 1 during operation.

FIG. 6 is a schematic illustration of an electrical configuration for the color cathode ray tube of the present invention of FIG. 1 during operation.

The electrons emitted from the cathode K heated by the heater H are formed into a beam by the first grid electrode G1 (grounded) and the second grid electrode G2 (at 650 V for example), and then they are focused by the third grid electrode G3 (at 7 kV, for example), the fourth grid electrode G4, the fifth grid electrode G5, the intermediate electrode GM and the sixth grid electrode G6 (the anode) to impinge upon the phosphor screen 4.

In the electron gun 9 of this type, the sixth grid electrode G6 is supplied with the anode voltage Eb, a highest voltage (30 kV, for example), the intermediate electrode GM is supplied with a voltage (16.5 kV corresponding to 55% of the anode voltage, for example) divided from the anode voltage Eb using the voltage-dividing resistor 25, the fifth grid electrode G5 and the third grid electrode G3 are connected together within the cathode ray tube and supplied with a same voltage (7 kV, for example), the fourth grid electrode G4 and the second grid electrode G2 are also connected together internally and are supplied with a direct voltage (650 V, for example), and the first grid electrode G1 is grounded. The cathodes K are supplied with video signals, respectively.

In FIG. 6, the shield wire 29 for suppression of discharge attached to the fifth grid electrode G5 is indicated by broken lines. The conductive film 29A for suppression of discharge is formed by evaporating a portion of metal contained in the shield wire 29 onto the inner wall of the neck portion 2 by heating the shield wire 29 using a radio-frequency induction heater external to the neck portion 2, after the spot-knocking step.

Figure 7:
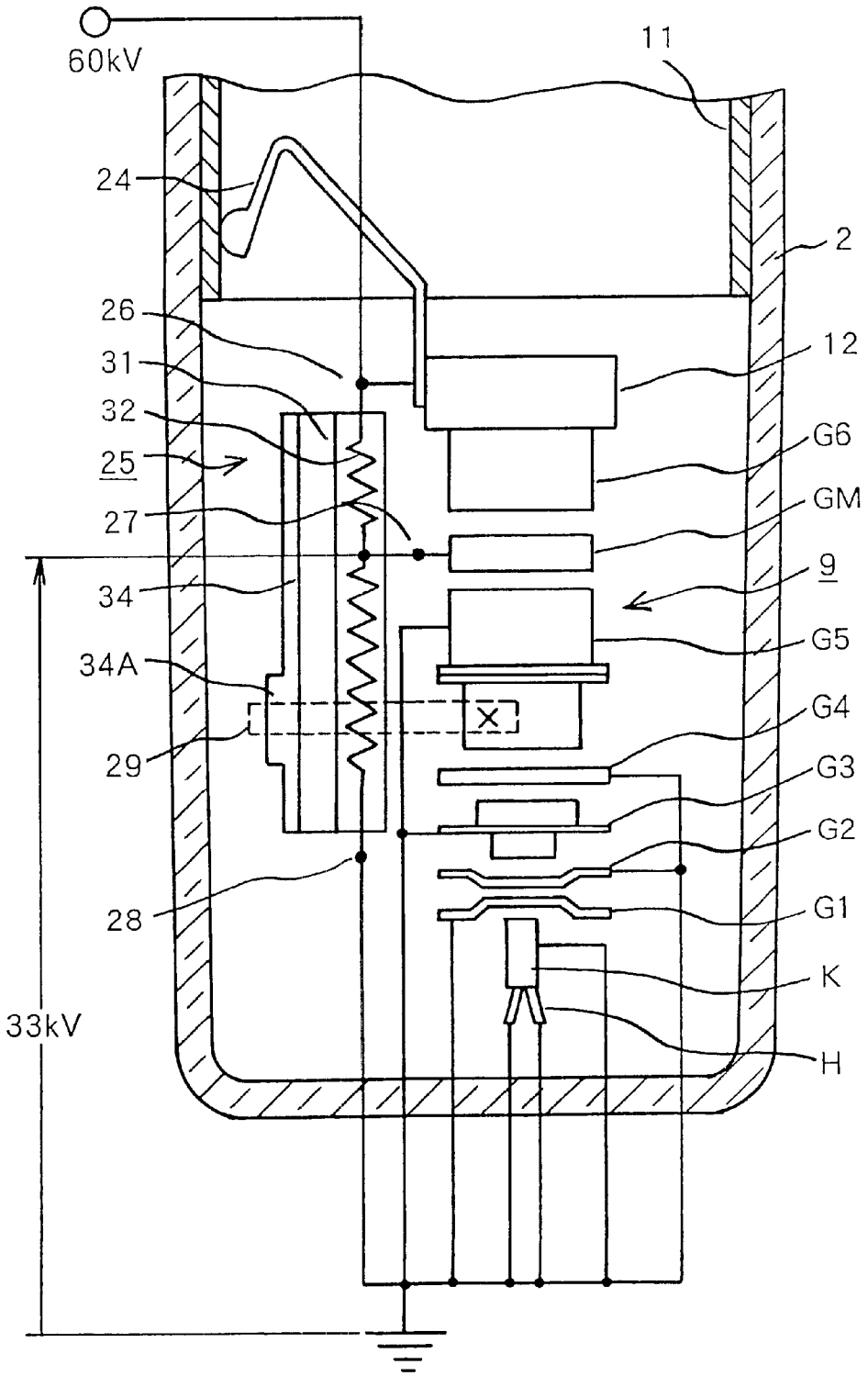
FIG. 7 is a schematic illustration of an electrical configuration for spot-knocking the color cathode ray tube of the present invention of FIG. 1.
Figure 8:
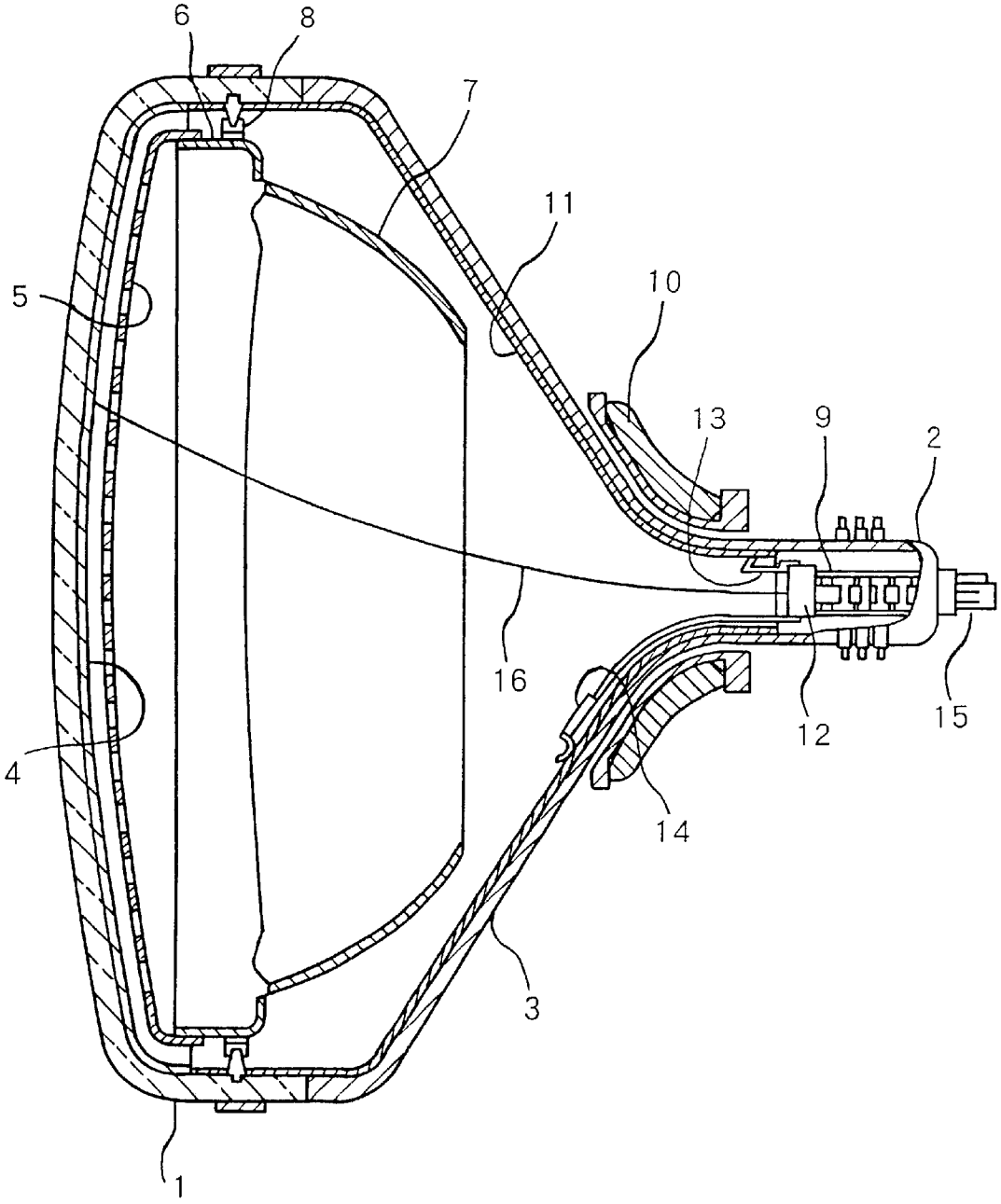
FIG. 8 (PRIOR ART)
FIG. 8 is a cross-sectional view of an exemplary prior art color cathode ray tube.
Figure 9:
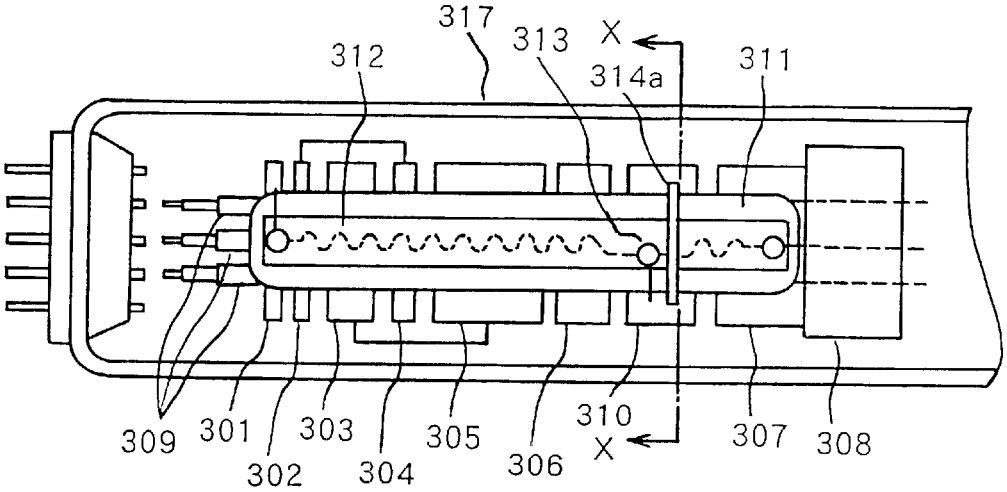
FIG. 9 (PRIOR ART)
FIG. 9 is a schematic longitudinal cross-sectional view of an electron gun of a prior art cathode ray tube.
Figure 10:
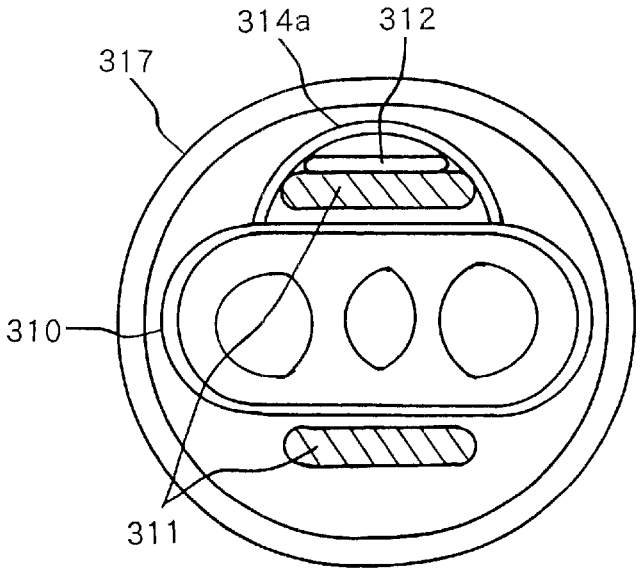
FIG. 10 (PRIOR ART)
FIG. 10 is a cross-sectional view taken along line X—X of the electron gun of FIG. 9.

The following explains the spot-knocking procedure. FIG. 7 is a schematic illustration of an electrical configuration for spot-knocking the color cathode ray tube of the present invention of FIG. 1 in the manufacturing steps. In the spot-knocking step, the conductive film 29A for suppression of discharge is not formed on the inner wall of the neck portion 2 yet, because the conductive film 29A would be dispersed in the spot-knocking step.

For purpose of comparison, first consider the case where a cathode ray tube incorporates the internal voltage-dividing resistor 25 without the thickened portion 34A of the overcoat glass film 34 in accordance with the present invention. After the cathode ray tube has been exhausted of gases and sealed, all the electrodes except for the sixth grid electrode G6 and the intermediate electrode GM are grounded, a high voltage of 60 kV is applied to the sixth grid electrode G6, and a voltage of 33 kV divided from the high voltage of 60 kV via the voltage-dividing resistor 25 is applied to the intermediate electrode GM.

The purpose of the spot-knocking step is to remove projections in electrodes of the electron gun or foreign particles within the cathode ray tube by forcing arcing between the sixth grid electrode G6 and the intermediate electrode GM, between the intermediate electrode GM and the fifth grid electrode G5, the sixth grid electrode G6 and the inner wall of the neck portion 2, and between the intermediate electrode GM and the inner wall of the neck portion 2, by applying 27 kV and 33 kV between the sixth grid electrode G6 and the intermediate electrode GM, and between the intermediate electrode GM and the fifth electrode G5, respectively.

But arcing occurs between the shield wire 29 for suppression of discharge and the resistance element 32 of the voltage-dividing resistor 25 through the ceramic substrate 31 and the overcoat glass film 34 because the voltage-dividing resistor 25 is supplied with the high voltage of 60 kv and the fifth grid electrode G5 to which the shield wire 29 is electrically connected is grounded during the spot-knocking step, and as a result cracking occurs passing through the ceramic substrate 31 and the overcoat glass film 34. Consequently, voltage differences large enough to produce arcing are not obtained between the sixth grid electrode G6 and the intermediate electrode GM, between the intermediate electrode GM and the fifth grid electrode G5, the sixth grid electrode G6 and the inner wall of the neck portion 2, and between the intermediate electrode GM and the inner wall of the neck portion 2, and the sufficient effects of the spot-knocking are not obtained.

Now consider the case where a cathode ray tube incorporates the internal voltage-dividing resistor 25 provided with the thickened portion 34A in the overcoat glass film 34 in accordance with the present invention as shown in FIG. 7. After the cathode ray tube of the present invention has been exhausted of gases and sealed, all the electrodes except for the sixth grid electrode G6 and the intermediate electrode GM are grounded, the high voltage of 60 kV is applied to the sixth grid electrode G6, and the voltage of 33 kV divided from the high voltage of 60 kV via the voltage-dividing resistor 25 is applied to the intermediate electrode GM.

In the cathode ray tube of the present invention, the thickened portion 34A of the overcoat glass film 34 is provided between the resistance element 32 at the high voltage and the grounded shield wire 29 for suppression of discharge such that the withstand voltage between the resistance element 32 and the shield wire 29 for suppression of discharge is increased and consequently, occurrence of arcing is prevented between the resistance element 32 at the high voltage level and the grounded shield wire 29. As a result, 27 kV and 33 kV are applied between the sixth grid electrode G6 and the intermediate electrode GM and between the intermediate electrode GM and the fifth grid electrode G5, respectively, and sufficiently strong arcing is produced between the sixth grid electrode G6 and the intermediate electrode GM, between the intermediate electrode GM and the fifth grid electrode G5, the sixth grid electrode G6 and the inner wall of the neck portion 2, and between the intermediate electrode GM and the inner wall of the neck portion 2, resulting in sufficient removal of projections in electrodes of the electron gun or foreign particles within the cathode ray tube.

After the spot-knocking step, as shown in FIG. 2, the conductive film 29A for suppression of discharge during the normal operation of the completed cathode ray tube is formed on the inner wall of the neck portion 2 by evaporating a portion of metal contained in the shield wire 29 onto the inner wall of the neck portion 2 heating the shield wire 29 using a radio-frequency induction heater external to the neck portion 2.

In the above-explained embodiment, the present invention is applied to the three-beam in-line type electron gun, but it is needless to say that the present invention is also applicable to a one-beam electron gun.

The present invention provides the following advantages. In the present invention, the internal voltage-dividing resistor comprises a first overcoat insulating film, a resistance element, an insulating substrate and a second overcoat insulating film stacked in the order named from the first overcoat insulating film facing one of the glass beads for fixing the electrodes of the electron gun, a portion of the second overcoat insulating film containing a region thereof facing a metal conductor for suppression of discharge is locally thickened to prevent occurrence of arcing between the resistance element of the voltage-dividing resistor supplied with a high voltage and the grounded metal conductor during the spot-knocking step such that the effect of the spot-knocking is heightened and thereby the withstand voltage characteristics during the normal operation of the completed cathode ray tube is improved.

What is claimed is:

1. A cathode ray tube comprising:

an evacuated envelope comprising a panel portion having a phosphor screen formed on an inner surface thereof, a neck portion and a funnel portion connecting said panel portion and said neck portion;

an electron gun housed in said neck portion comprising at least one cathode, a first grid electrode, a second grid electrode, a plurality of focus electrodes and an anode arranged in the order named for focusing at least one electron beam emitted from said at least one cathode on said phosphor screen, said at least one cathode, said first grid electrode, said second grid electrode, said plurality of focus electrodes and said anode being fixed in predetermined axially spaced relationship by at least two glass beads;

a voltage-dividing resistor attached to one of said at least two glass beads for producing an intermediate voltage to be applied to a first one of said plurality of focus electrodes adjacent to said anode by dividing a voltage applied to said anode; and a metal conductor facing and attached to a second one of said plurality of focus electrodes to surround said voltage-dividing resistor and said one of said at least two glass beads, said second one of said plurality of focus electrodes being disposed upstream of said first one of said plurality of focus electrodes;

said voltage-dividing resistor comprising a first overcoat insulating film, a resistance element, an insulating substrate and a second overcoat insulating film stacked in the order named from said first overcoat insulating film facing said one of said at least two glass beads, and a portion of said second overcoat insulating film containing a region thereof facing said metal conductor being made locally thicker than a remainder of said second overcoat insulating film.

2. The cathode ray tube according to claim 1, wherein said locally thicker portion of said second overcoat insulating film extends a distance of three to eight times a width of said metal conductor as measured in a direction of an axis of said cathode ray tube.

3. The cathode ray tube according to claim 2, wherein said insulating substrate is ceramic and 0.6 mm to 1.0 mm in thickness, said second overcoat insulating film is made of glass and a thickness of said locally thicker portion of said second overcoat insulating film is in a range of 0.19 mm to 0.45 mm.

4. The cathode ray tube according to claim 3, wherein said second overcoat insulating film is made of lead-containing glass.

5. The cathode ray tube according to claim 1, wherein said insulating substrate is 0.6 mm to 1.0 mm in thickness, said second overcoat insulating film is made of glass and a thickness of said locally thicker portion of said second overcoat insulating film is in a range of 0.19 mm to 0.45 mm.

6. The cathode ray tube according to claim 5, wherein said second overcoat insulating film is made of lead-containing glass.

* * * * *